US007581662B2

(12) United States Patent
Powell

(10) Patent No.: US 7,581,662 B2
(45) Date of Patent: Sep. 1, 2009

(54) MULTI-COMPARTMENT SPRAY DISPENSER WITH COMMON PRESSURIZER

(76) Inventor: Michael Powell, 5641 W. Pine Cir., Crystal River, FL (US) 34429

( * ) Notice: Subject to any disclaimer, the term of this patent is extended or adjusted under 35 U.S.C. 154(b) by 794 days.

(21) Appl. No.: 11/019,073

(22) Filed: Dec. 21, 2004

(65) Prior Publication Data

US 2006/0131331 A1 Jun. 22, 2006

(51) Int. Cl.
*B65D 83/00* (2006.01)

(52) U.S. Cl. ..... 222/401; 222/135; 222/136; 222/137; 222/144.5; 222/402

(58) Field of Classification Search ..... 222/135–137, 222/401–402, 94, 385, 383.1, 386.5, 144.5; 169/76, 78

See application file for complete search history.

(56) References Cited

U.S. PATENT DOCUMENTS 1,964,362 A * 6/1934 Nassif ..... 222/136
2,421,765 A * 6/1947 Taylor ..... 222/135
3,581,946 A 6/1971 Meshberg
3,606,963 A 9/1971 Marand
3,760,986 A * 9/1973 Castner et al. ..... 222/137
3,770,165 A * 11/1973 Steiman et al. ..... 222/136
3,862,705 A 1/1975 Beres et al.
4,238,054 A 12/1980 Chen
4,526,191 A * 7/1985 Pomponi, Jr. ..... 137/206
4,821,923 A 4/1989 Skorka
5,009,342 A 4/1991 Lawrence et al.
5,152,431 A 10/1992 Gardner et al.
5,370,275 A 12/1994 Mills et al.
5,398,846 A 3/1995 Corba et al.
5,439,141 A 8/1995 Clark et al.
5,562,250 A 10/1996 O'Neill
6,082,588 A 7/2000 Markey et al.

* cited by examiner

*Primary Examiner*—Frederick C. Nicolas
(74) *Attorney, Agent, or Firm*—Larson and Larson, PA; Frank Liebenow

(57) ABSTRACT

A multi-compartment spray dispenser with common pressurizer includes a single container divided into four sub-chambers, each of which is separate from each of the other sub-chambers. Each sub-chamber has its own separate outlet. A pumping mechanism is common to the sub-chambers and causes pressurization of the sub-chambers simultaneously. When it is desired to dispense liquid from one of the sub-chambers, a hose connection is coupled to the hose connection on the container, thereby opening a flow path for liquid through a hose connected to the hose connector and a nozzle having an actuating valve. Should flow of liquid slow, it is easy to re-pressurize the sub-chamber through operation of the pumping mechanism.

18 Claims, 4 Drawing Sheets

MULTI-COMPARTMENT SPRAY DISPENSER WITH COMMON PRESSURIZER

BACKGROUND OF THE INVENTION

The present invention relates to a multi-compartment spray dispenser with common pressurizer. In the prior art, it is known to provide a single container with a plurality of liquids to be dispensed. However, the prior art known to Applicant fails to contemplate all of the features and aspects of the present invention.

U.S. Pat. No. 5,009,342 to Lawrence et al. discloses a container having two sub-chambers and control means to determine which of the chambers is connected to the outlet nozzle. The present invention differs from the teachings of Lawrence et al. as contemplating a container having a plurality of sub-chambers that are commonly pressurized, but each of which has its own separate outlet nozzle.

Another known configuration consists of a container having a plurality of sub-chambers and a single nozzle, whereby liquid from a plurality of sub-chambers is mixed together and commonly dispensed. U.S. Pat. No. 3,581,946 to Meshberg, U.S. Pat. No. 3,862,705 to Beres et al. and U.S. Pat. No. 5,398,846 to Corba et al. teach this general configuration. The present invention differs from the teachings of these patents as contemplating a plurality of separate sub-chambers, each of which is permitted to dispense liquid contained therein through its own dispensing nozzle without any mixing of liquid with any other sub-chamber.

It is also known to provide a device in which a container has a plurality of sub-chambers, each of which has its own pump and a common actuator for the pumps, whereby movement of the common actuator causes simultaneous dispensing of liquids from different chambers. U.S. Pat. No. 6,082,588 to Markey et al. teaches such a configuration. The present invention differs from the teachings of Markey et al. as contemplating separate sub-chambers within a container, each of which is able to dispense liquid through a separate outlet without intermixing and independently of dispensing from other sub-chambers.

U.S. Pat. No. 5,152,431 to Gardner et al. teaches a pump apparatus for dispensing liquid from a selected one of a plurality of sub-chambers. Gardner et al. teach a single pumping dispenser and a mechanism allowing only one sub-chamber to be fluidly connected to the pumping dispenser at any one time, whereby a chosen sub-chamber's liquid is dispensed independently of other sub-chambers. The present invention differs from the teachings of Gardner et al. as contemplating a plurality of sub-chambers isolated from one another, but commonly pressurized, with each sub-chamber having its own outlet and nozzle.

Finally, U.S. Pat. No. 4,238,054 to Chen teaches a container including a common mechanism for pressurizing a plurality of sub-chambers and whereby a common outlet is provided for all of the sub-chambers along with control means controlling which sub-chamber is fluidly connected to the outlet to dispense fluid therefrom. The present invention differs from the teachings of Chen as contemplating a container having a plurality of sub-chambers that are commonly pressurized, but wherein each sub-chamber has its own separate outlet nozzle and may dispense liquid independently of the other sub-chambers.

SUMMARY OF THE INVENTION

The present invention relates to a multi-compartment spray dispenser with common pressurizer. The present invention includes the following interrelated objects, aspects and features:

(1) In a first aspect, the present invention contemplates a single container divided into, in the example shown, four sub-chambers, each of which is separate from each of the other sub-chambers. Each sub-chamber has its own outlet port separate from the outlets of the other sub-chambers including a hose connection adapted to be connected to a hose and nozzle dispenser.

(2) A pumping mechanism is common to the sub-chambers and includes a pump handle that may be reciprocated to cause pressurization of each of the sub-chambers simultaneously. The pump handle extends through an opening in a cap or lid that may be removed to allow access to the sub-chambers so that they may be filled with liquid to be dispensed.

(3) With the cap or lid sealed on the neck of the container, the pumping mechanism is operated to pressurize the sub-chambers. The hose connection ports maintain each sub-chamber sealed closed by virtue of a check valve incorporated therein in a manner well known to those of ordinary skill in the art. When it is desired to dispense liquid from one of the sub-chambers, a hose connection is coupled to the hose connection port on the container, thereby opening a flow path for liquid through a hose connected to the hose connector and a nozzle having an actuating valve. When the actuating valve is closed, liquid is dispensed through the nozzle. Should flow of liquid slow, it is easy to re-pressurize the sub-chamber through operation of the pumping mechanism.

As such, it is a first object of the present invention to provide a multi-compartment spray dispenser with common pressurizer.

It is a further object of the present invention to provide such a device wherein a container is provided with a plurality of sub-chambers that are independently provided with liquid to be dispensed.

It is a yet further object of the present invention to provide such a device wherein each separate sub-chamber has its own outlet to which a hose connection may selectively be coupled to permit dispensing of liquid therefrom.

It is a yet further object of the present invention to provide such a device wherein a lid or cap may be removed from the container to allow filling of the separate sub-chambers.

These and other objects, aspects and features of the present invention will be better understood from the following detailed description of the preferred embodiment when read in conjunction with the appended drawing figures.

DETAILED DESCRIPTION OF THE PREFERRED EMBODIMENT

Figure 1:
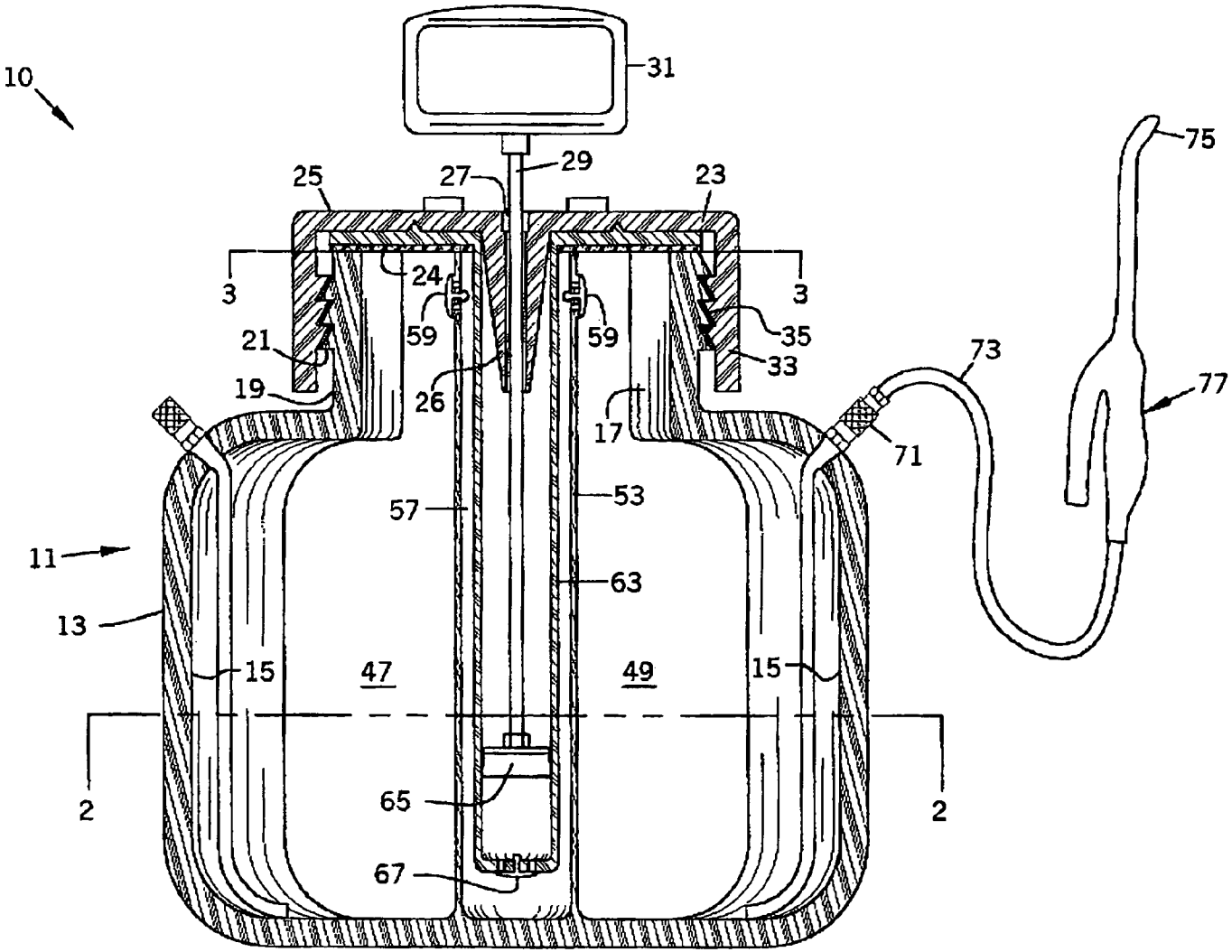
FIG. 1 shows a longitudinal side elevational cross-sectional view through the inventive device.

With reference to the Figures, the present invention is generally designated by the reference numeral 10 and is seen to include a container 11 having an outer wall 13 and an inner wall 15 that extends peripherally within the container 11. The container 11 has an upwardly extending neck 17 having an outer wall 19 including a plurality of threads 21. A cap or lid 23 has a top wall 25 with an opening 27 through which a pump stem 29 extends that also includes a gripping pump handle 31. The cap or lid 23 has a side wall 33 with female threads 35 that enmesh with the male threads 21 of the neck 17 to cause the lid 23 to be receivable on the neck 17 in sealing relation thereover.

Figure 2:
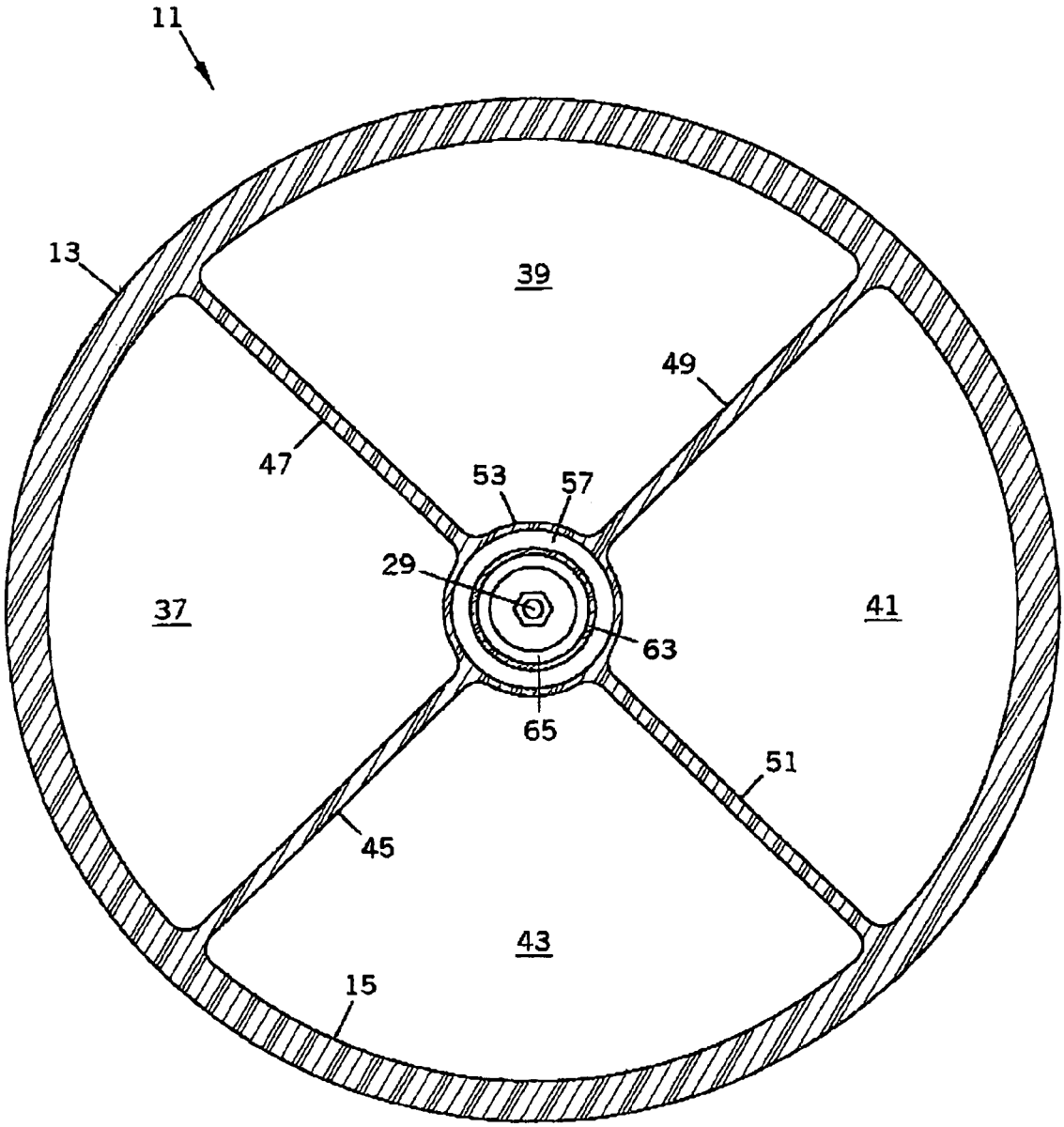
FIG. 2 shows a cross-sectional view along the line 2-2 of FIG. 1.
Figure 3:
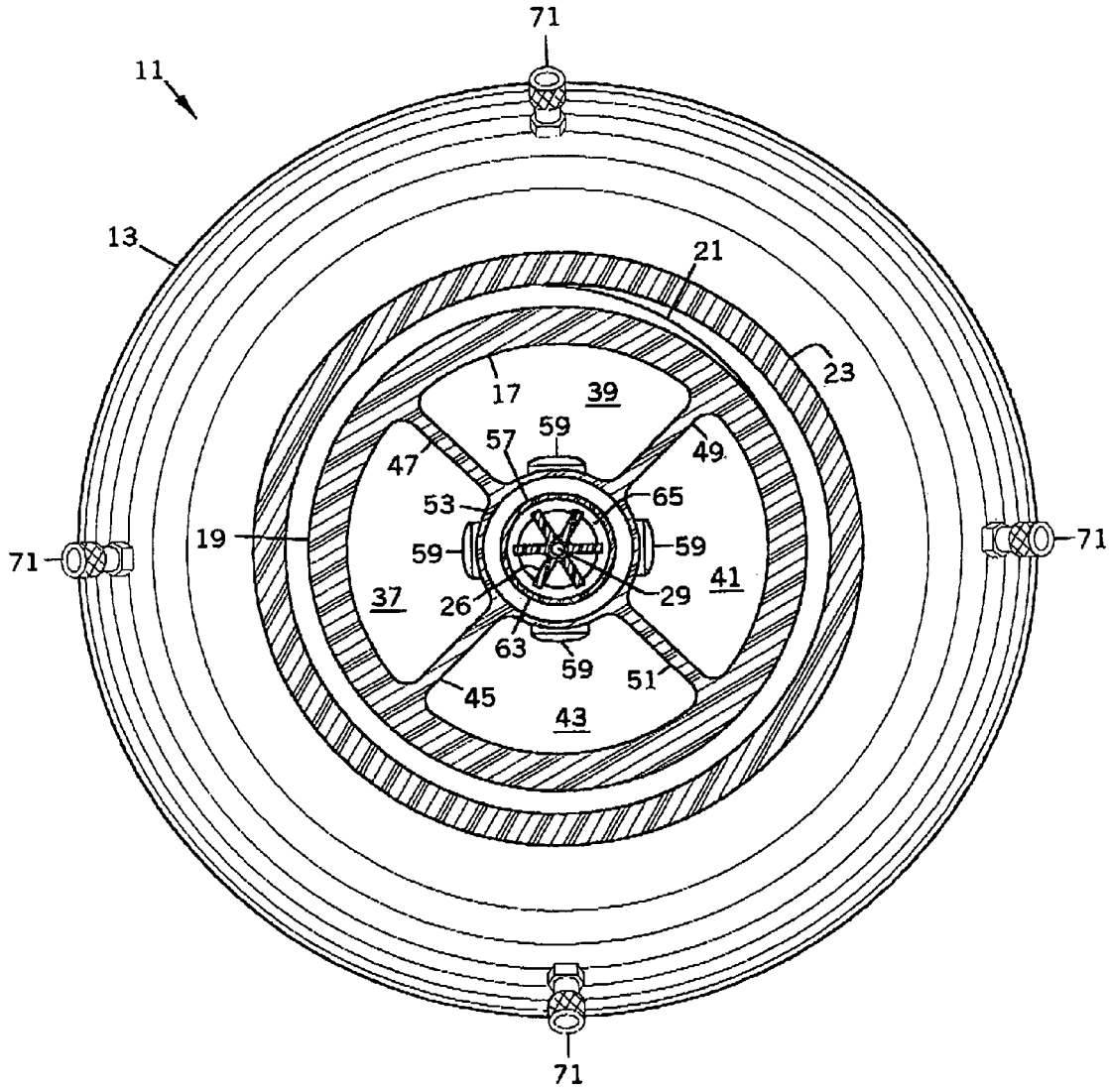
FIG. 3 shows a cross-sectional view along the line 3-3 of FIG. 1.
Figure 4:
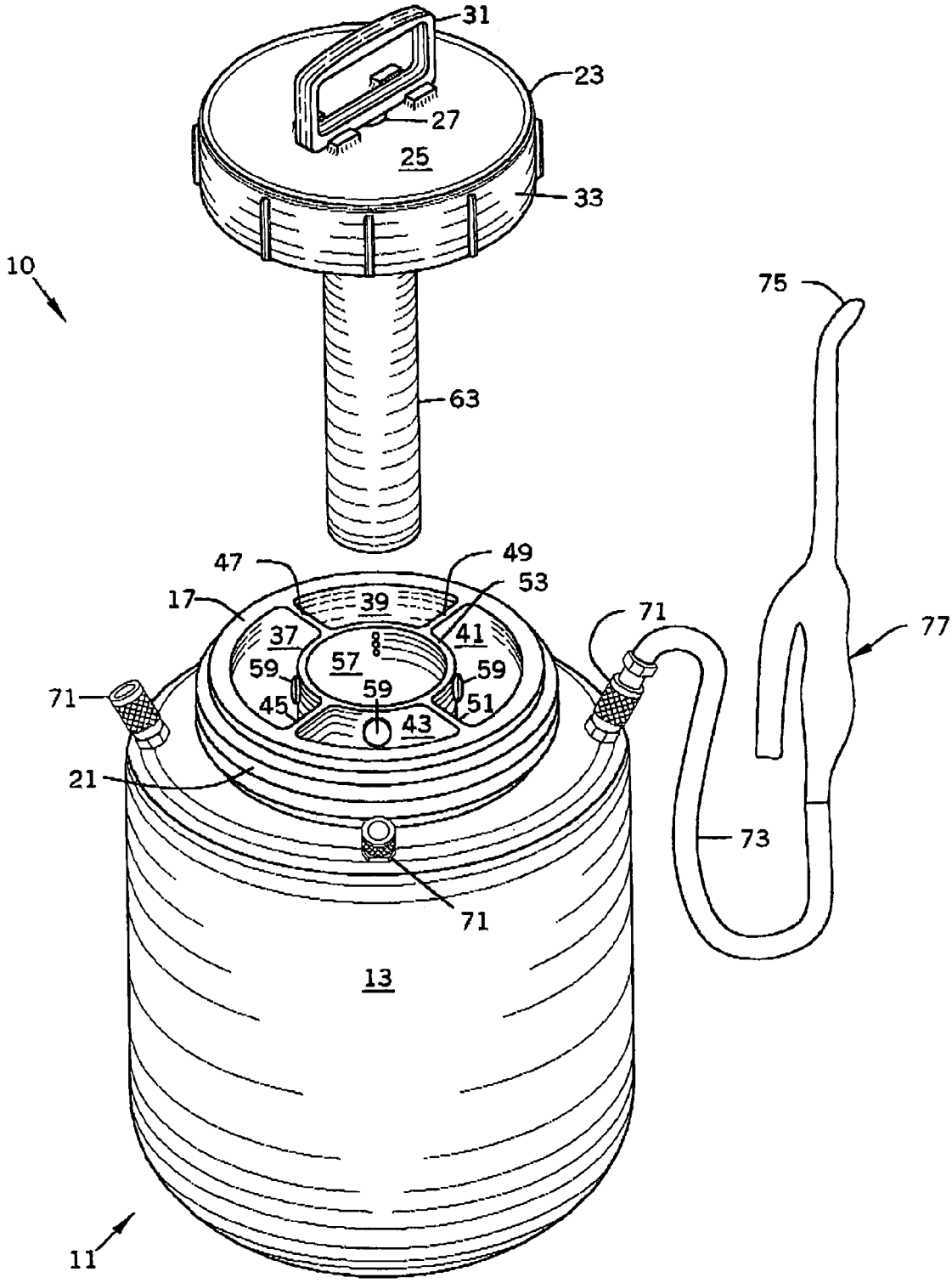
FIG. 4 shows a perspective view of the dispenser and pressure pump.

In further explanation, with reference to the Figures, the peripheral wall 15 is common to four sub-chambers 37, 39, 41 and 43 (FIGS. 2 and 3, in particular). Vertical walls 45, 47, 49 and 51 divide the space enclosed within the peripheral wall 15 into the four sub-chambers, with these walls extending between the inner peripheral surface 15 and an inner cylindrical wall 53. The wall 53 defines the outer periphery of a pumping chamber 57 that is connected to each sub-chamber by the check valves 59 (FIG. 3). The check valves 59 permit flow from the pumping chamber 57 into the sub-chambers 37, 39, 41 and 43, and preclude reverse flow from the sub-chambers into the pumping chamber 57.

Within the pumping chamber 57, with particular reference to FIGS. 1 and 3, an inner cylinder 63 receives a piston 65 attached to the stem 29 as best seen in FIG. 1. Thus, when the handle 31 is gripped and reciprocated up and down in the view of FIG. 1, the stem 29 is constrained to move therewith, and the piston 65 is constrained to move with the handle 31. A check valve 67 (FIG. 1) in the bottom of the cylinder 63 allows air compressed by the piston 65 to exit from the cylinder 63 and into the periphery of the pumping chamber 57 where the air thence travels through the check valves 59 to pressurize the sub-chambers 37, 39, 41 and 43. An opening 27 allows air to enter the cylinder 63 along slot 26. Alternatively, the stem 29 could be made hollow and extend through the piston 65 with a check valve mounted on the bottom of the piston 65 and with the upper portion of the stem 29 always exposed to atmosphere. In this way, when the piston 65 is reciprocated upwardly in the view of FIG. 1, the check valve 67 is closed, precluding reverse flow of air into the cylinder 63 and air travels through the hollow stem 29 and through the check valve (not shown) in the piston 65 to fill the cylinder 63 below the piston 65 with air. When the piston 65 is then reciprocated downwardly in the view of FIG. 1, the check valve (not shown) in the piston 65 is closed, and the check valve 67 is opened to allow air below the piston 65 to be pumped into the outer portion of the pumping chamber 57 and thence out the check valves 59 to the sub-chambers.

With reference to FIG. 1, the lid 23 has a seal 24 on its undersurface. When the lid 23 is threadably received over the neck 17 in the position shown in FIG. 1, the seal 24 engages between the lid 23 on the one hand, and the uppermost extensions of the neck 17, the cylindrical wall 53, and the cylinder 63, to thereby hermetically seal the pumping chamber 57 and each of the sub-chambers 37, 39, 41 and 43.

With reference to FIGS. 1 and 3, each sub-chamber has an outlet fitting 71, preferably consisting of a hose connection having a coupling spring biased check valve therein that seals its respective sub-chamber when a hose is not coupled thereto. As shown in FIG. 1, a hose 73 may be coupled to the hose connection 71. In a manner well known to those of ordinary skill in the art (U.S. Pat. No. 4,114,853 incorporated herein by reference), when the hose 73 is coupled to the hose connector 71, the check valve internal to the hose connector 71 is opened allowing pressurized liquid from the respective sub-chamber to enter the hose 73 and travel toward the nozzle 75 (FIG. 1) FIG. 1 schematically shows an actuator 77 for the hose 73 on nozzle 75 which may consist of any valve that may selectively be actuated, preferably, manually, to fluidly connect the interior of the sub-chamber to which the hose 73 is coupled to the nozzle 75, wherein liquid from the sub-chamber may suitably be dispensed. When it is desired to stop liquid flow, the valve 77 is closed. When flow through the nozzle 75 slows or ceases with the valve 77 open, the user merely must reciprocate the handle 31 up and down to cause the piston 65 to reciprocate within the cylinder 63 and thereby re-pressurize all of the sub-chambers 37, 39, 41 and 43.

When it is desired to fill the sub-chambers with liquid or to replenish one or more of the sub-chambers from which liquid has been dispensed, it is only necessary to unscrew the lid 23 from the neck 17, whereupon each of the sub-chambers is exposed as shown in FIG. 3, in particular, so that one or more of the sub-chambers may easily be replenished with liquid to be dispensed. As shown in FIGS. 1 and 3, the stem 29 is supported within the lid 23 by a support neck 26 that includes a plurality of splines (FIG. 3) to strengthen while lightening the support.

In the preferred embodiment of the present invention, the container and lid are made of any suitable molded plastic as are the cylinder 63 and the outer peripheral wall 57 of the pumping chamber. The stem 29, handle 31, and piston 65 may be made of any suitable plastic or metal. The check valves may be made of any suitable resilient material such as rubber or synthetic rubber or soft plastic.

As such, an invention has been disclosed in terms of a preferred embodiment thereof which fulfills each and every one of the objects of the invention as set forth hereinabove, and provides a new and useful multi-compartment spray dispenser with common pressurizer of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

Having thus described the invention, what is claimed and desired to be secured by Letters Patent is:

1. A multi-compartment spray dispenser, comprising:

a) a container having an upwardly facing opening and an inner chamber divided into a plurality of fluidly separate sub-chambers, said sub-chambers being fillable through said opening;

b) an air pump mounted within said inner chamber and having an inlet connected to atmosphere and a plurality of outlets, each outlet connected to a separate sub-chamber, the air pump includes a reciprocating pump member, the reciprocating pump member comprises a piston reciprocably received within a cylinder contained within said chamber;

c) each sub-chamber having a port to which an outlet nozzle is connectable;

d) whereby said pump is operable to simultaneously pressurize all of said sub-chambers and each sub-chamber is adapted to dispense fluid contained therein independently.

2. The dispenser of claim 1, further including a stem attached to said piston and having an end remote from said piston extending outside said container and having a hand grip.

3. The dispenser of claim 1, wherein each of said outlets is connected to a separate sub-chamber via a check valve precluding the fluid flow into said pump.

4. The dispenser of claim 2, wherein each of said outlets is connected to a separate sub-chamber via a check valve precluding the fluid flow into said pump.

5. The dispenser of claim 4, further including a further check valve defining a cylinder outlet and precluding flow of the fluid into said cylinder.

6. The dispenser of claim 1, wherein said upwardly facing opening is closeable by a removable lid.

7. The dispenser of claim 6, wherein said lid is threadably received on a neck of said container defining said upwardly facing opening.

8. The dispenser of claim 1, wherein said plurality of sub-chambers comprises four sub-chambers.

9. The dispenser of claim 1, wherein each port includes a coupling and a check valve that prevents the fluid flow from said sub-chamber in a first position thereof and permits the fluid flow from said sub-chamber in a second position thereof.

10. The dispenser of claim 9, wherein a hose is connectable to each port, said hose moving said check vale to said second position when coupled to said port.

11. The dispenser of claim 1, wherein said container is made of plastic.

12. The dispenser of claim 10, wherein said plurality of sub-chambers comprises four sub-chambers.

13. A multi-compartment spray dispenser, comprising:

a) a container having an upwardly facing opening and an inner chamber divided into four fluidly separate sub-chambers, said sub-chambers being fillable through said opening, said upwardly facing opening being closeable by a removable lid;

b) a reciprocating air pump mounted within said inner chamber and having an inlet connected to atmosphere and a plurality of outlets, each outlet connected to a separate sub-chamber by a separate check valve;

c) each sub-chamber having a port to which an outlet nozzle is connectable;

d) whereby said pump is operable to simultaneously pressurize all of said sub-chambers and each sub-chamber is adapted to dispense fluid contained therein independently.

14. The dispenser of claim 13, wherein said pumping member comprises a piston reciprocably received within a cylinder contained within said chamber.

15. The dispenser of claim 14, further including a stem attached to said piston and having an end remote from said piston extending outside said container and having a hand grip.

16. The dispenser of claim 15, further including a further check valve defining a cylinder outlet and precluding flow of the fluid into said cylinder.

17. The dispenser of claim 13, wherein said lid is threadably received on a neck of said container defining said upwardly facing opening.

18. The dispenser of claim 13, wherein each port includes a coupling and a check valve that prevents the fluid flow from said sub-chamber in a first position thereof and permits the fluid flow from said sub-chamber in a second position thereof.

* * * * *